US006370256B1

(12) United States Patent
McGrath

(10) Patent No.: US 6,370,256 B1
(45) Date of Patent: Apr. 9, 2002

(54) TIME PROCESSED HEAD RELATED TRANSFER FUNCTIONS IN A HEADPHONE SPATIALIZATION SYSTEM

(75) Inventor: David Stanley McGrath, Sydney (AU)

(73) Assignee: Lake DSP Pty Limited, Ultimo (AU)

( * ) Notice: Subject to any disclaimer, the term of this patent is extended or adjusted under 35 U.S.C. 154(b) by 0 days.

(21) Appl. No.: 09/283,664

(22) Filed: Mar. 31, 1999

(30) Foreign Application Priority Data

Mar. 31, 1998 (AU) ..... PP2728

(51) Int. Cl.[7] ..... H04R 5/02
(52) U.S. Cl. ..... 381/310
(58) Field of Search ..... 381/309, 310

(56) References Cited

U.S. PATENT DOCUMENTS 5,371,799 A * 12/1994 Lowe et al. ..... 381/310
5,495,534 A * 2/1996 Inanaga et al. ..... 381/310
5,809,149 A * 9/1998 Cashion et al. ..... 381/17
5,854,843 A * 12/1998 Jacknin et al. ..... 381/309
5,987,142 A * 11/1999 Courneau et al. ..... 381/17
6,021,205 A * 2/2000 Yamada et al. ..... 381/310
6,108,430 A * 8/2000 Kurisu ..... 381/310
6,181,800 B1 * 1/2001 Lambrecht ..... 381/310

* cited by examiner

*Primary Examiner*—Forester W. Isen
*Assistant Examiner*—Brian Pendleton
(74) *Attorney, Agent, or Firm*—Knobbe, Martens, Olson & Bear, LLP

(57) ABSTRACT

An apparatus for implementing a Head Related Transfer Function on an input audio signal in a headtracked listening environment comprising: a series of principle component filters attached to the input audio signal and each outputting a predetermined simulated sound arrival; a series of delay elements each attached to a corresponding one of the principle component filters and delaying the output of the filter by a variable amount depending on a delay input so as to produce a filter delay output; a summation means interconnected to the series of delay elements and summing the filter delay outputs to produce an audio speaker output signal; headtrack parameter mapping unit having a current orientation signal input and interconnected to each of the series of delay elements so as to provided the delay inputs.

11 Claims, 3 Drawing Sheets

TIME PROCESSED HEAD RELATED TRANSFER FUNCTIONS IN A HEADPHONE SPATIALIZATION SYSTEM

FIELD OF THE INVENTION

The present invention relates to the field of sound spatialization.

BACKGROUND OF THE INVENTION

Recently, the present applicant has proposed a system for spatialization of sound whereby sound signals are spatialized to remain constant when played over headphones and in the presence of head movement detected by a headtracking device.

In other known arrangements, principal component analysis is utilized to alter the HRTF functions so as to simulate the effect of sound movements.

Often, there are extremely subtle effects at play when a listener attempts to locate sounds spatially.

SUMMARY OF THE INVENTION

It is an object of the present invention to provide for an improved form of spatialization of sounds in a headtracked environment.

In accordance with a first aspect of the present invention, there is provided an apparatus for implementing a Head Related Transfer Function on an input audio signal in a headtracked listening environment comprising: a series of principle component filters attached to the input audio signal and each outputting a predetermined simulated sound arrival; a series of delay elements each attached to a corresponding one of the principle component filters and delaying the output of the filter by a variable amount depending on a delay input so as to produce a filter delay output; a summation means interconnected to the series of delay elements and summing the filter delay outputs to produce an audio speaker output signal; headtrack parameter mapping unit having a current orientation signal input and interconnected to each of the series of delay elements so as to provide the delay inputs.

Each of the delay elements further can include a gain factor unit adapted to multiply the filter delay output by an amount determined by a gain input signals to the delay element and the headtrack parameter mapping unit output a gain input signal to each of the delay elements.

In accordance with a further aspect of the present invention, there is provided a method for implementing a Head Related Transfer Function on an audio signal in a headtracked listening environment, the method comprising the steps of: filtering the audio signal by a series of principle component filters to produce a series of filtered component outputs; delaying each of the filtered component outputs by an amount dependant on a current listener's head orientation to produced delayed principal components; combining the delayed principal components to form an output audio speaker signal.

BRIEF DESCRIPTION OF THE DRAWINGS

Notwithstanding any other forms which may fall within the scope of the present invention, preferred forms of the invention will now be described, by way of example only, with reference to the accompanying drawings in which.

DESCRIPTION OF PREFERRED AND OTHER EMBODIMENTS

It has been found during research conducted by the present applicant that, when attempting to simulate changing HRTF functions in principal component analysis type systems, it is significant that complex interrelationships exist for HRTF of spatially adjacent sound sources. It is often the case that the components of impulse responses of adjacently located sound sources will undergo complex fluctuations with respect to one another. In particular, certain time delays of components with respect to one another are found to be highly significant.

Figure 1:
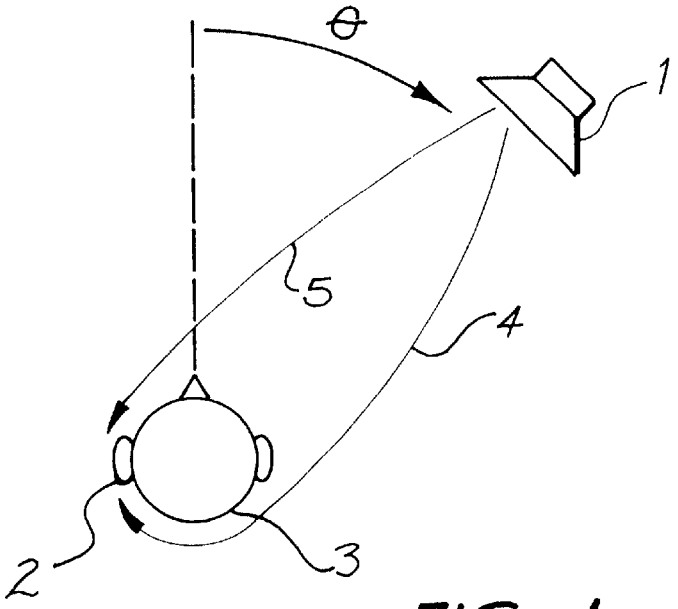
FIG. 1 illustrates an example of the sound paths to a listener's ear.
Figure 2:
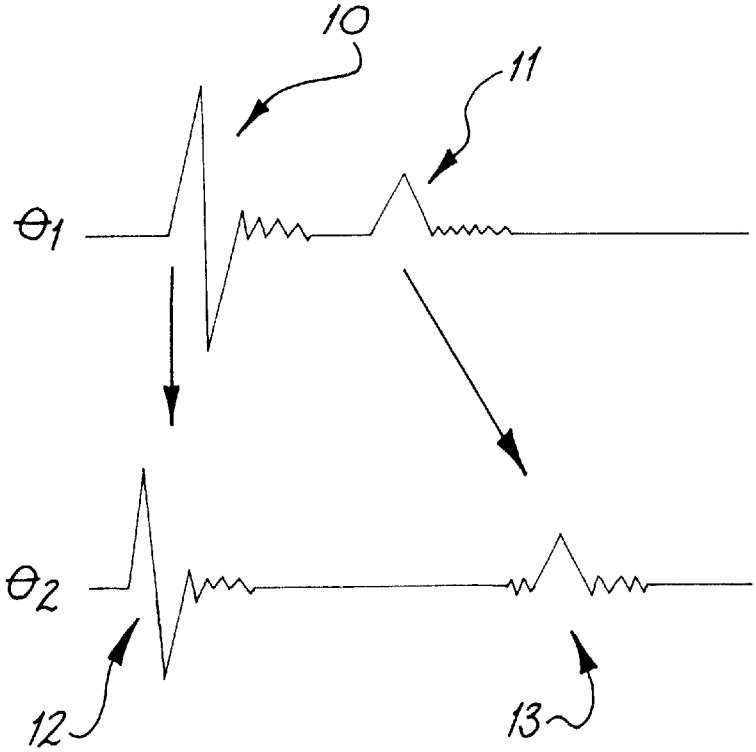
FIG. 2 illustrates portions of an impulse response for different angles around a listener's ear.

Turning to FIG. 1, there is illustrated a sound emitted from a speaker 1 placed at a position θ which includes two pathways to the ear 2 of a listener 3 (Other pathways such as reflections off walls and portions of the listeners body may also be present). As θ changes the two paths 4,5 undergo complex temporal and amplitude changes with respect to one another. For example, in FIG. 2 there is shown example impulse responses for two arbitrary angles $\theta_1$ and $\theta_2$. The main arrivals 10, 11 undergo subtle shifts 12, 13 in relative time and amplitude as θ changes.

Figure 3:
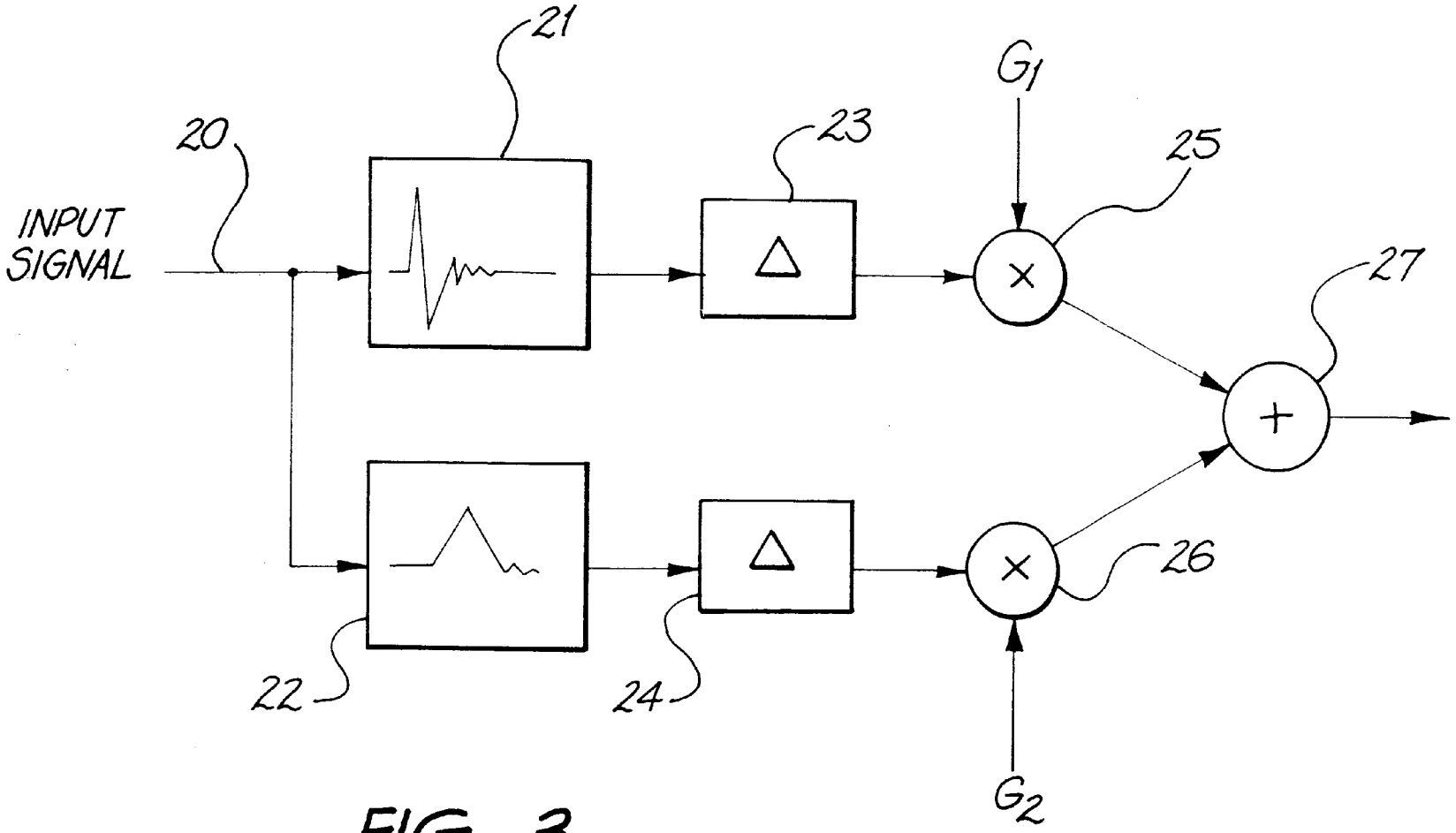
FIG. 3 is a schematic block diagram of a first simplified embodiment.

A study of these time delays leads to a design for providing improved localization as illustrated in a initial simplified form in FIG. 3. In this respect, an input 20 is fed to a series of filters 21, 22. The filters implement the principle component analysis technique based on a current position measure by a headtracking unit. The filter outputs are fed to variable delays 23–24 with the delay being predetermined for a particular head angle in accordance with previously conducted measurements. The outputs are then gain factored 25, 26, again, being dependant on θ before being added together 27 to form a final output.

Figure 4:
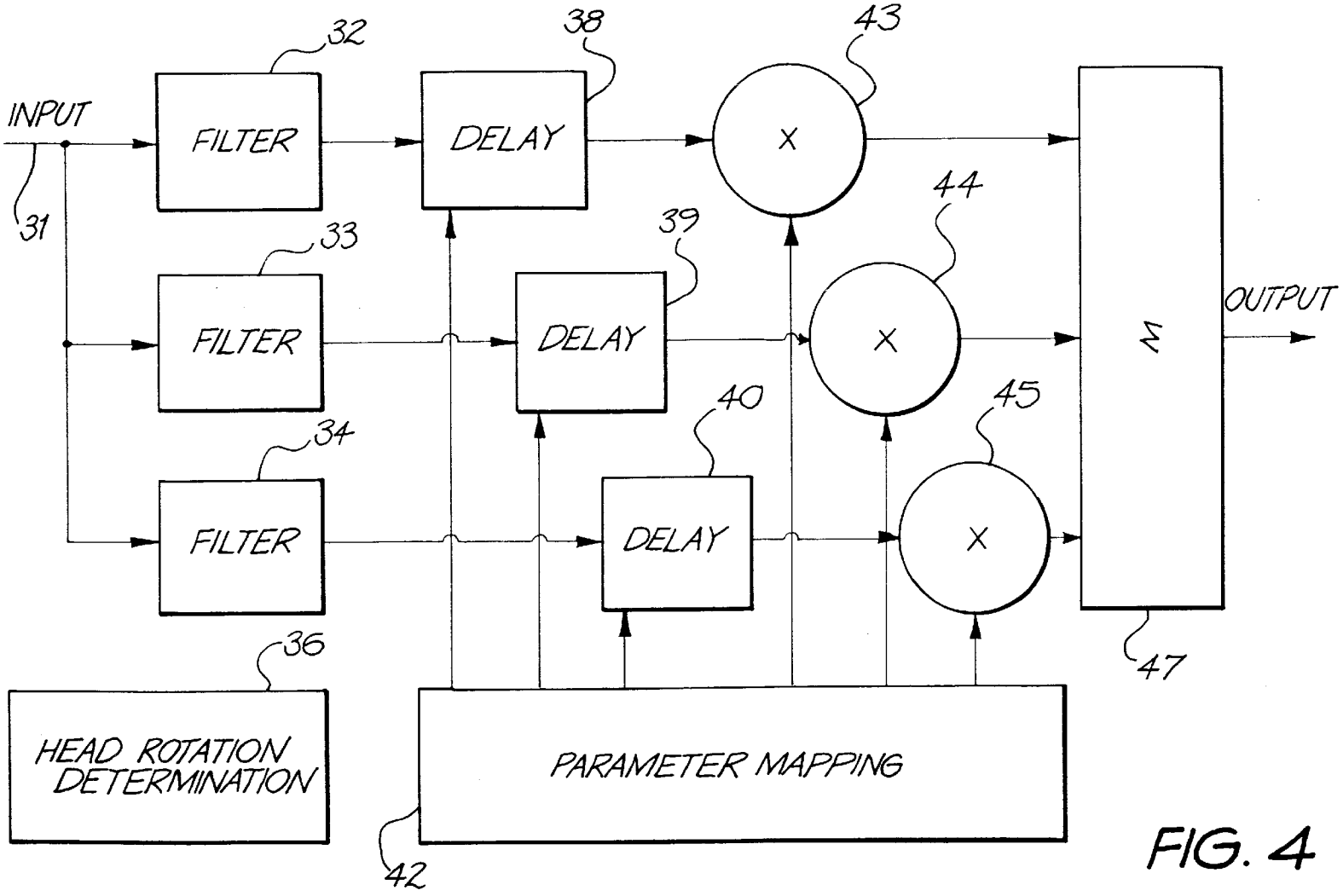
FIG. 4 is a schematic block diagram of a second embodiment of the invention.

FIG. 4 shows the extension of the arrangement of FIG. 3 to a more complex overall structure handling 3 principle components. An audio input 31 is filtered 32–34 to provide 3 principle components which undergo relative delays 38–40 and gain factoring 43–45 before being summed 47 and output as a headphone channel.

The headphones include a rotation angle determination unit (such headphones being well known in the art), and the head rotation determination 36 is fed to a parameter mapping unit 42 (which can be primarily a predetermined lookup table) which outputs delay and gain values for a particular input angle.

It would be further appreciated by a person skilled in the art that numerous variations and/or modifications may be made to the present invention as shown in the specific embodiments without departing from the spirit or scope of the invention as broadly described. The present embodiments are, therefore, to be considered in all respects to be illustrative and not restrictive.

I claim:

1. An apparatus for implementing a Head Related Transfer Function on an input audio signal from a single sound source in a headtracked listening environment comprising:

a series of principal component filters attached to receive said input audio signal and each outputting a principal component corresponding to a portion of a predetermined simulated sound arrival from the sound source with the portions together forming said predetermined simulated sound arrival;

a series of delay elements each attached to a corresponding one of said principal component filters, each delay element being arranged to delay the output of said filter by a variable amount depending on a delay input so as to produce a filter delay output;

a summer interconnected to said series of delay elements and summing said filter delay outputs to produce a monaural audio speaker output signal; and a headtrack parameter mapping unit having a current orientation signal input and interconnected to each of said series of delay elements so as to provide said delay inputs to said delay elements.

2. The apparatus of claim 1, wherein each of said delay elements further includes a gain factor unit adapted to multiply said filter delay output by an amount determined by a gain input signal to said delay element, with said headtrack parameter mapping unit being arranged to output said gain input signal to each of said gain factor units.

3. A method of implementing a Head Related Transfer Function on an audio signal from a single sound source in a headtracked listening environment, said method comprising:

filtering said audio signal by a series of principal component filters to produce a series of filtered component outputs, each of said principal component filters outputting a portion of a predetermined simulated sound arrival from the sound source with the portions together forming said predetermined simulated sound arrival;

delaying each of said filtered component outputs by an amount dependent on a current listener's head orientation so as to produce delayed principal components; and combining said delayed principal components to form a monaural output audio speaker signal.

4. The apparatus of claim 1, wherein each one of the portions of the predetermined simulated sound arrival is representative of a different signal pathway between the single sound source and an ear of a listener.

5. The apparatus of claim 4, wherein at least some of the different signal pathways are reflected by the listener's body.

6. The apparatus of claim 2, wherein the headtrack parameter mapping unit includes a lookup table which is arranged to output delay and gain values for an angle formed between the sound source and the orientation of the listener's head.

7. The method of claim 3, further comprising adjusting the gain of each one of said filtered component outputs by an amount dependent on a current listener's head orientation so as to produce delayed principal components of differing amplitudes.

8. The method of claim 7, further comprising predetermining the delay of each one of the filtered components by measuring the delays for a series of particular head angles and storing the delays in a parameter mapping unit.

9. The method of claim 8, further comprising determining the current listener's head orientation and outputting delay and gain values for an angle formed between the sound source and the orientation of the listener's head.

10. The method of claim 3, wherein each delayed principal component is representative of each one of said different signal pathways between the single sound source and an ear of a listener.

11. The method of claim 10, wherein at least some of the different signal pathways are reflected by the listener's body.

* * * * *